United States Patent [19]

Fujino et al.

[11] 4,219,306

[45] Aug. 26, 1980

[54] MULTISTAGE TURBOCOMPRESSOR WITH MULTIPLE SHAFTS

[75] Inventors: Yoshikazu Fujino, Kobe; Yoshiaki Daido, Akashi, both of Japan

[73] Assignee: Kawasaki Jukogyo Kabushiki Kaisha, Kobe, Japan

[21] Appl. No.: 16,737

[22] Filed: Mar. 2, 1979

[30] Foreign Application Priority Data

Mar. 7, 1978 [JP] Japan ..... 53-26120

[51] Int. Cl.[3] ..... F04D 25/16

[52] U.S. Cl. ..... 415/62; 415/66

[58] Field of Search ..... 415/60, 62, 66, 68, 415/143, 199.1, 199.2, 199.3, 199.6

[56] References Cited

U.S. PATENT DOCUMENTS 2,405,284 8/1946 Birman ..... 415/199.6

3,001,692 9/1961 Schierl ..... 415/66

FOREIGN PATENT DOCUMENTS 114335 10/1899 Fed. Rep. of Germany ..... 415/143

*Primary Examiner*—Louis J. Casaregola

*Attorney, Agent, or Firm*—Haseltine, Lake & Waters

[57] ABSTRACT

The impellers of two rotary compressors are respectively fixed to the opposite ends of each shaft of a plurality of shafts, the compressors being connected in succession by connecting pipes to constitute a single multistage combination of the compressors in successive compression stages, the impeller of the preceding stage of the impellers on each shaft having a gas exit flow angle which is less than that of the impeller of the succeeding stage thereby to cause the specific speed of each impeller to be at its optimal value.

6 Claims, 3 Drawing Figures

MULTISTAGE TURBOCOMPRESSOR WITH MULTIPLE SHAFTS

BACKGROUND OF THE INVENTION

This invention relates generally to multistage turbocompressors and more particularly to a type thereof wherein the impellers of a plurality of rotary compressors are mounted on each of a plurality of rotating shafts, and all of the compressors are connected by gas conducting means to constitute a single multistage combination of the compressors in successive compression stages. An important feature of this multistage compressor of this invention is that an impeller of a preceding stage among the impellers on each shaft has an exit flow angle which is less than that of the impeller of the succeeding stage thereby to cause the specific (rotational) speed of each impeller to be within its optimal range.

In general, a gaseous fluid such as air or a gas possesses compressibility, and, therefore, when the gaseous fluid is compressed for the purpose of raising its pressure, its volume decreases according to Boyle's law (also known as Mariotte's law) as is well known. For a 4-stage compressor to suck in air and produce a discharge or delivery pressure of 7 kg.f/cm$^2$ G, it is necessary that the pressure ratio (i.e., the ratio of the absolute discharge and suction pressures) of each stage be selected at a value of the order of 1.7, and the volumetric flow rate of the gaseous fluid sucked into a fan wheel or impeller is reduced approximately 60 percent upon reaching the entrance of the succeeding stage.

For the purpose of obtaining a discharge or delivery pressure of 7 kg.f/cm$^2$ G with 3-stage compression, it is necessary to select a pressure ratio of approximately 2 for each stage. In this case, the volumetric flow rate at the entrance of the impeller of the succeeding stage is decreased to approximately 50 percent of that of the preceding stage. Thus, as the pressure ratio per stage increases, the rate of decrease of the volumetric flow rate of the gaseous fluid sucked into the impeller of a succeeding stage increases.

On one hand, in order for the impeller of each stage to exhibit high efficiency, it is required that the specific (rotational) speed $N_s$ expressed by the following equation be within an optimum range for each stage.

$$N_s = N \cdot Q^{1/2} / H_{ad}^{3/4}, \tag{1}$$

where: N is the impeller rotation speed (r.p.m.); Q is the volumetric flow rate (m$^3$/min.) of each stage; and $H_{ad}$ is the adiabatic head (m.) of each stage. This specific speed $N_s$ is derived from the fluid mechanical law of similarity of turboblowers and compressors. It is a quantity having an important relation to the performance of the turbomachine and is an essential factor also in the selection of the type of the impellers.

Among the types of impellers, the common types are the centrifugal type, the diagonal-flow or "mixed-flow" type, and the axial-flow or propeller type. For each type, there is an optimum specific speed, and impellers of equal specific speed $N_s$ become geometrically similar impellers irrespective of their sizes and their rotational speeds. Furthermore, the optimum value of the specific speed $N_s$ has the characteristic of increasing with increasing width of the impeller blades in the centrifugal type and, further, with transformation into the diagonal-flow type.

Heretofore, in multistage turbocompressors, the impellers of the multiple stages have been of the axial-flow type, the centrifugal type, or a combination of the two types. For example, in one common type, centrifugal type impellers of two compressors of end-suction type are fixedly mounted respectively on opposite cantilever end portions of a single rotating shift. The two impellers are thus mounted at spaced-apart positions with their suction entrance sides facing away from each other. The shaft is driven by power transmitted to a driven gear fixedly mounted thereon at its middle part between the two impellers. One of the compressors is a first-stage compressor whose entrance is an end-suction port and its exit or discharge port is connected by way of a pipeline or flow passage to the entrance port of the other compressor, which is a second-stage compressor. Thus, the two compressors in combination constitute a two-stage compressor. The outer diameters of the first-stage and second-stage impellers are $D_a$ and $D_b$, respectively.

In a multistage compressor of this character employing only centrifugal type impellers, it is necessary to make all impellers geometrically similar in order to cause the specific speed $N_s$ of each impeller to be of optimum value. For this purpose, since the suction volumetric flow rate Q decreases in the downstream stages, as mentioned hereinabove, it is necessary to reduce the size of the downstream stage impeller in accordance with the decrease of the flow rate Q. More specifically, it is necessary to reduce the outer diameter $D_b$ of the second-stage impeller in the above described example, for instance.

On one hand, since the adiabatic head $H_{ad}$ is proportional to the square of the outer circumferential velocity of an impeller, it is necessary to increase the rotational speed of the second-stage in inverse proportion to the impeller outer diameter, in order to make equal the adiabatic heads $H_{ad}$ and hence the pressure ratios of the stages. In order to realize this in actual practice, however, it is necessary to mount the impellers on separate, respectively independent rotating shafts, which will give rise to an increase in the number of machine parts and complication of the compressor construction.

Accordingly, it has been a practice heretofore to install two compressors on a single rotating shaft, whereby the rotational speeds of the impellers of the two compressors are made equal, and to make the shapes of these impellers substantially geometrically similar with the outer diameter $D_b$ of the second-stage impeller made smaller in proportion to $\sqrt[3]{Q}$. The reason for this is that the relationships between the adiabatic head $H_{ad}$ and the impeller outer diameter D and the volumetric flow rate Q are as follows.

$$H_{ad} \overset{\propto}{\alpha} D^2 \tag{2}$$

From Eq. (1), $$H_{ad} \overset{\propto}{\alpha} Q^{\frac{2}{3}} \tag{3}$$

From Eqs. (2) and (3), $$D \overset{\propto}{\alpha} Q^{\frac{1}{3}} \tag{4}$$

More specifically, in the above described example of a two-stage compressor with impellers mounted on a single shaft, the following equation is used in its design.

$$D_b/D_a \approx \sqrt[3]{Q_b/Q_a}, \tag{5}$$

where $Q_a$ and $Q_b$ are the suction volumetric flow rates of the impellers of the first and second stages, respectively. In the case of a pressure ratio of 2 as mentioned hereinbefore, the suction volumetric flow rate $Q_b$ of the second stage is 50 percent of that of the first stage. For this reason, the impeller outer diameter $D_b$ of the second stage, from Eq. (5), is $\sqrt[3]{0.5}$, that is, 79 percent, of the impeller outer diameter $D_a$ of the first stage. Therefore, the adiabatic head of the second stage decreases to $(0.79)^2$, that is, 63 percent, of that of the first stage.

For this reason, in order to obtain a specific pressure rise required of the compressor as a multistage turbocompressor, it is necessary to increase further the rotational speed of the common shaft or to increase the number of stages. However, the former measure is not possible in the case where the outer circumferential velocity of the impeller of the first stage is the allowable limit for the material of the impeller, while the latter measure leads to not only high cost but ordinarily also to difficulties relating to construction.

Furthermore, even in the case where, fortunately, the required rotational speed of the shaft is within the limits set by the strength of the material of the first-stage impeller and the required fluid mechanical performance, since the centrifugal force acting on the second-stage impeller decreases in proportion to the square of the outer circumferential velocity, it becomes 63 percent of the centrifugal force of the first-stage impeller. This means that this centrifugal force of the second-stage is much lower than the allowable stress based on the strength of the impeller material, whereby the second-stage impeller has superfluous strength from the viewpoint of efficiency of material utilization, and the cost is unnecessarily high.

SUMMARY OF THE INVENTION

It is an object of this invention to overcome the above described problems encountered in the prior art by providing a multistage compressor of an organization wherein the impellers of a plurality of rotary compressors are mounted on each of a plurality of rotating shafts, and the compressors are connected by gas conducting means to constitute a single multistage combination of the compressors in successive compression stages, an impeller of a preceding stage of the impellers on each shaft having an exit flow angle which is less than that of the impeller of the succeeding stage thereby to cause the specific speeds of all impellers to be at their respective optimal values. By this provision, a high efficiency and high pressure-raising capacity is attained in the multistage compressor of this invention. Furthermore, the strength possessed by the material of each of the impellers is effectively utilized. As a result, the total number of stages of the compressor can be reduced, whereby the entire compressor can be made small.

The nature, utility, and further features of this invention will be more clearly apparent from the following detailed description with respect to a preferred embodiment of the invention when read in conjunction with the accompanying drawings, which are briefly described below, and in which like parts are designated by like reference numerals.

DETAILED DESCRIPTION

Figure 1:
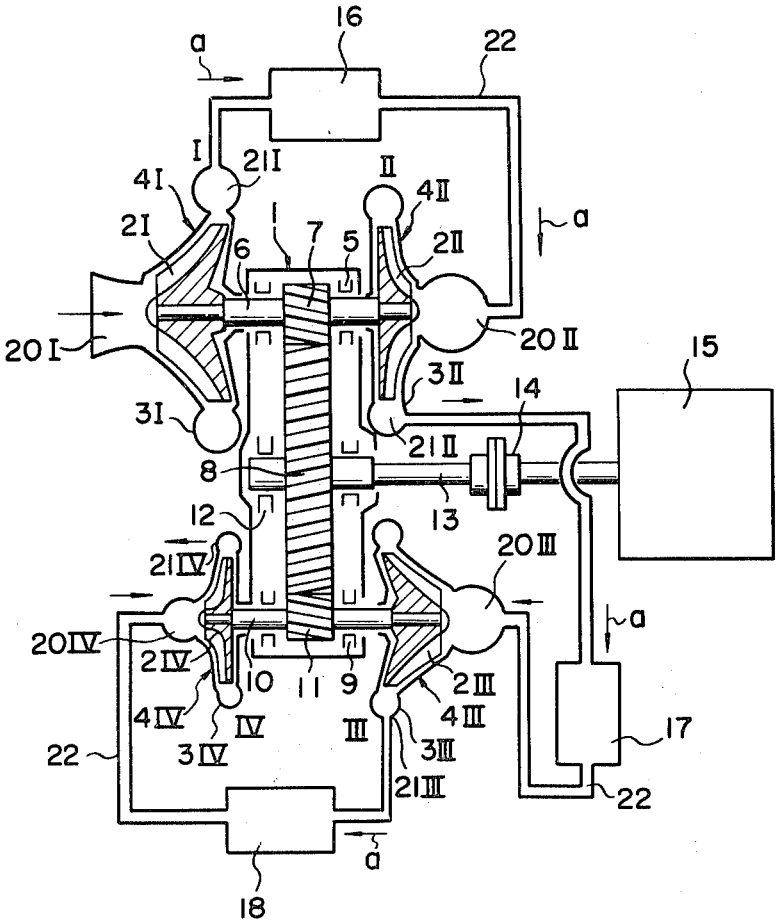
FIG. 1 is a diagrammatic side view, in longitudinal section, showing the essential organization of one example of a compressor of geared speed-increase type constituting an embodiment of this invention.
Figure 2:
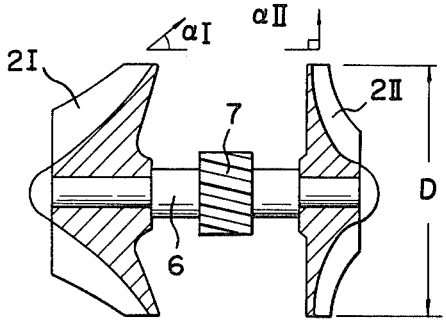
FIG. 2 is a relatively enlarged side view showing essential parts of the compressor illustrated in FIG. 1.

Referring to FIGS. 1 and 2, the example of a multistage turbocompressor according to this invention illustrated therein is a geared speed-increase type compressor of 2-shaft, 4-stage arrangement, the impellers of all four stages being of the end-suction type. As shown in FIG. 1, the turbocompressor has a casing 1 which houses a speed-increasing mechanism and constitutes a main structure of the compressor. To this casing 1 are secured four compressor casings, 3I, 3II, 3III, and 3IV respectively housing four impellers 2I, 2II, 2III, and 2IV. The Roman numerals I, II, III, and IV are used herein to designate the first, second, third, and fourth stages of the multistage turbocompressor. The impellers 2I through 2IV and the casings 3I through 3IV respectively constitute four compressors 4I, 4II, 4III, and 4IV.

The first-stage impeller 2I is of the diagonal-flow, end-suction type, while the second-stage impeller 2II is of the centrifugal, end-suction type. These two impellers 2I and 2II are mounted in overhanging state respectively on opposite ends of a single rotating shaft 6 rotatably supported by two bearings 5. The bearings 5 are positioned between the impellers 2I and 2II and respectively on opposite sides of a pinion 7 provided at the middle part of the shaft 6 and meshed with a large driving gear 8.

The third-stage impeller 2III is of the diagonal-flow, end-suction type, while the fourth-stage impeller 2IV is of the centrifugal, end-suction type. These two impellers 2III and 2IV are also mounted in overhanging state respectively on opposite ends of another single rotating shaft 10 rotatably supported on bearings 9. The bearings 9 are positioned between the impellers 2III and 2IV and respectively on opposite sides of a pinion 11 provided at the middle part of the shaft 10 and meshed with the large driving gear 8.

The driving gear 8 is mounted on a low-speed shaft 13 rotatably supported on bearings 12 and coupled at one end thereof by a coupling 14 to the output shaft of a motive power means or driving machine 15. The rotation of the driving machine 15 is increased in rotational speed in correspondence with the gear ratios of the driving gear 8 and the pinions 7 and 11, whereby the shafts 6 and 10 are rotated at high speed such that the impellers 2I, 2II, 2III, and 2IV mounted thereon produce their respective required pressure ratios. In the case where the driving gear 8 is meshed with a plurality of pinions such as pinions 7 and 11, in general, their speed-increase ratios differ, and the rotational speeds of the shafts 6 and 10 are ordinarily different.

Intermediate coolers 16, 17, and 18, which are separate from the main structure of the compressor, are respectively connected by connecting pipes 22 between the discharge port 21I of the compressor 4I and the suction port 20II of the compressor 4II, between the discharge port 21II of the compressor 4II and the suction port 20III of the compressor 4III, and between the discharge port 21III of the compressor 4III and the suction port 20IV of the compressor 4IV.

As shown in FIG. 1, the compressors 4I and 4II of the first and second stages are provided on the opposite ends of the same shaft 6, whereby the rotational speeds of their impellers 2I and 2II are equal. Similarly, the compressors 4III and 4IV of the third and fourth stages are also provided on the opposite ends of the same shaft 10, whereby the rotational speeds of their impellers 2III and 2IV are equal.

In the illustrated example, the first-stage and third-stage impellers 2I and 2III are of the diagonal-flow type, known also as the "mixed-flow" type. A diagonal-flow impeller is generally defined as an impeller which has a gas entrance at which the gas being impelled flows in the axial direction and an exit at which the gas flows out in a direction diagonal to or inclined to the axial direction.

Figure 3:
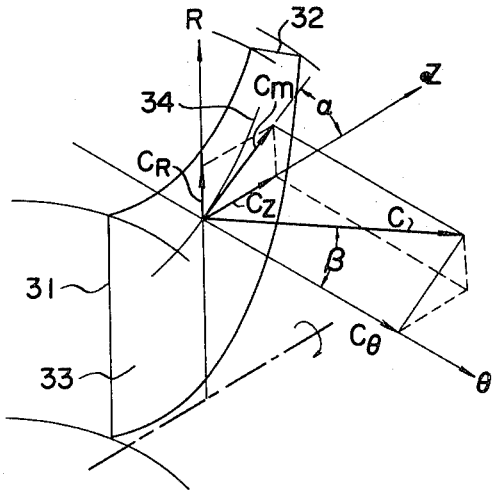
FIG. 3 is a perspective diagram for a description of the flow of a gas within an impeller.

More specifically, in FIG. 3, it will be assumed that a meridional plane 33 exists in the gas flow path through an impeller from its entrance 31 to its exit 32. In this case, at a streamline 34 within the meridional plane, the exit velocity C of the gas flowing out from the impeller has not only a radial component $C_R$ and a tangential component $C_\theta$ as in a centrifugal type impeller but also an axial component $C_Z$. Accordingly, when the exit flow angle at the exit 32 of the impeller, that is, the angle $\alpha$ between the velocity component $C_m$ along the above mentioned streamline and the axial direction Z, becomes zero degrees, the impeller becomes one of axial-flow type, while when the angle $\alpha$ becomes 90 degrees, the impeller becomes one of centrifugal type. For this reason, an impeller exhibiting characteristics of a diagonal-flow type, in actual practice, has a exit flow angle $\alpha$ in the range of 20 to 70 degrees.

In this case, such an impeller is suitable for use for characteristics intermediate between those of the centrifugal type and those of the axial-flow type, for example, for use in an intermediate specific speed region. The smaller the exit flow angle $\alpha$ is, the greater is the specific speed $N_s$, and the higher is the efficiency. Thus, in a diagonal-flow impeller, an optimal specific speed $N_s$ which is greater than that of a centrifugal type impeller of the same outer diameter can be used. As is apparent from Eq. (1), the volumetric flow rate Q is proportional to the square of the specific speed $N_s$. Therefore, a diagonal-flow impeller, which has a high optimal specific speed $N_s$, can process a greater flow rate, in comparison with that of a centrifugal impeller of the same outer diameter, proportionally to the square of the ratio of the optimal specific speeds $N_s$ of the two types of impellers.

Because of such characteristics of a diagonal-flow impeller, in accordance with this invention, the exit flow angle $\alpha$I of the first-stage impeller 2I is set at a value less than the exit flow angle $\alpha$II of the second-stage impeller as shown in FIG. 2 so that the relationship between the optimal specific speeds and the volumetric flow rates of the first and second stages will be as expressed by the following equation.

$$N_{sI}/N_{sII}=\sqrt{QI/QII} \quad (6)$$

This applies to the case where the first-stage impeller 2I of diagonal-flow type and the second-stage impeller 2II of centrifugal type are fixedly mounted on a single shaft as described hereinabove and as shown in FIGS. 1 and 2. By this setting of the exit flow angles $\alpha$I and $\alpha$II, maximum efficiency is obtained by achieving optimal specific speeds $N_s$ respectively of the two impellers 2I and 2II having substantially the same outer diameter D while rotating at the same rotational speed.

Furthermore, it is possible to utilize the centrifugal forces of the impellers 2I and 2II similarly for the first and second stages fully up to the allowable limits for their materials. For example, in the case where the pressure ratio of each stage is 2, the volumetric flow rate at the entrance of the succeeding stage is approximately 50 percent of that of the preceding stage, as mentioned hereinbefore. For this reason, ratios of the optimum specific speeds is as follows.

$$N_{sI}/N_{sII}=\sqrt{1/0.5}=1.4 \quad (7)$$

Accordingly, in order to obtain the optimum specific speed ratio 1.4 in the instant embodiment of the invention, the impeller 2II of the succeeding stage was designed to be of centrifugal type, that is, the exit flow angle $\alpha$II was made equal to 90 degrees, while the impeller 2I of the preceding stage was designed to be of diagonal-flow type of an exit flow angle $\alpha$I of 45 degrees.

The relationship between the third-stage impeller 2III and the fourth-stage impeller 2IV fixed to the other shaft 10 shown in FIG. 1 is identical to that described above. Accordingly, the third-stage impeller 2III is of the diagonal-flow type of an exit flow angle of 45 degrees, while the fourth-stage impeller 2IV is of the centrifugal type.

The optimum specific speed ratio of the second-stage impeller 2II and the third-stage impeller 2III is set in the conventional manner by suitably selecting the numbers of gear teeth of the pinions 7 and 11, that is, in accordance with the difference between the rotational speeds of the rotating shafts 6 and 10 and the difference between the outer diameters of the impellers.

The multistage turbocompressor of the above described mechanical organization according to this invention operates as follows. As indicated in FIG. 1, a gaseous fluid a such as air or a gas is compressed and its pressure raised by the first-stage compressor 4I and, after passing through the intermediate cooler 16, is introduced into the second-stage compressor 4II whose impeller 2II is on the same rotating shaft 6. The gaseous fluid a is further compressed and its pressure raised by this compressor 4II.

In these compressing and pressure raising process steps, the specific speeds $N_{sI}$ and $N_{sII}$ of the impellers 2I and 2 II are within their respective optimal ranges, whereby the corresponding compressing efficiencies are high. Futhermore, the temperature of the gaseous fluid a compressed and pressurized by the first-stage compressor 4I is raised by the compression, but this gaseous fluid a is cooled by the intermediate cooler 16 by the time it enters the second-stage compressor 4II. Therefore, the compression steps approach isothermal compression, whereby the compression efficiency is further elevated.

The gaseous fluid a discharged from the second-stage compressor 4II is further cooled by the second intermediate cooler 17 and thereafter enters the third-stage compressor 4III whose impeller 2III is fixed to the other rotating shaft 10. The gaseous fluid a, after being further compressed in the third-stage compressor 4III, passes through the third intermediate cooler 18 and enters the fourth-stage compressor 4IV whose impeller 2IV is fixed to the same rotating shaft 10. The gaseous fluid a is thus compressed and pressurized up to the required pressure and is then discharged.

When the required delivery pressure is relatively low, the fourth-stage compressor 4IV is omitted in some cases, whereby the entire compressor becomes one of three-stage type. In other instances, compressors (not shown) in addition to the four of the four stages described above may be used with the use of three or more rotating shafts.

According to this invention, as described above, there is provided a multistage compressor in which the impellers of a plurality of rotary compressors are mounted on a plurality of different rotating shafts, and, of the impellers mounted on each single shaft, the impeller of the compressor of the preceding stage has an exit flow angle which is less than that of the impeller of the compressor of the succeeding stage thereby to cause the specific speeds of all impellers to be at their respective optimal values. By this provision, a high efficiency and high pressure-raising capacity is attained in the multistage compressor of this invention.

Furthermore, without impairing or adversely affecting the above advantageous features, all impellers are made to have the same outer diameter thereby to afford effective utilization of the material strength possessed by each impeller. This provision according to this invention makes possible a reduction in the number of rotating shafts or the number of compressors with respect to the pressure required of the compressor. This means that the size of the entire compressor can be reduced, and the construction thereof can be simplified.

In addition, while the external dimensions of a compressor, in general, are influenced by the outer diameter of the first-stage impeller having the largest outer diameter, since the first-stage impeller according to this invention is of the diagonal-flow type, the outer diameter of this diagonal-flow impeller is smaller than that of a conventional centrifugal type impeller for compressing with the same flow rate. For example, in the case of a pressure ratio of 2, the outer diameter of the diagonal-flow impeller becomes 79 percent of that of a centrifugal impeller of equivalent flow rate. On this point, also, reduction in size of the multistage compressor is facilitated.

What we claim is:

1. A multistage turbocompressor comprising: a plurality of rotary compressors for compressing a gas provided with respective impellers and connected by gas conducting means to constitute a single multistage combination of the compressors in successive compression stages; a plurality of separate rotating shafts each supporting a plurality of the impellers of consecutive stages; and motive power means for driving the rotating shafts, an impeller of a preceding stage among the impellers on each shaft having an exit flow angle which is less than that of the impeller of the succeeding stage thereby to cause the specific speeds of all impellers to be at the respective optimal values thereof, the exit flow angle of an impeller being the angle between the velocity component along a streamline within an imaginary meridional plane in the gas flow path through an impeller from its flow entrance to its flow exit, the velocity component being a component of the flow exit velocity, and the direction of the axis of rotation of that impeller.

2. A multistage turbocompressor according to claim 1 in which each shaft supports two impellers, of which at least the impeller of the preceding stage is a diagonal-flow impeller.

3. A multistage turbocompressor according to claim 2 in which each impeller on each shaft is of the end-suction type respectively fixed to opposite ends of the shaft, which thereby has cantilever ends and is driven at the middle part thereof by the motive power means.

4. A multistage turbocompressor according to claim 1 in which a gas cooling device is installed in the gas conducting means between each pair of adjacent compressors of a preceding stage and the succeeding stage.

5. A multistage turbocompressor according to claim 1 in which all impellers have the same outer diameter.

6. A multistage turbocompressor according to claim 1 in which all rotating shafts are interrelatedly driven by a single motive power means.

* * * * *

US004219306B1

REEXAMINATION CERTIFICATE (1752nd)

United States Patent [19]

[11] B1 4,219,306

Fujino et al.

[45] Certificate Issued Jul. 21, 1992

[54] MULTISTAGE TURBOCOMPRESSOR WITH MULTIPLE SHAFTS

[76] Inventors: Yoshikazu Fujino, Kobe; Yoshiaki Daido, Akashi, both of Japan

Reexamination Request:
No. 90/002,270, Feb. 6, 1991

Reexamination Certificate for:

| | |
|---|---|
| Patent No.: | 4,219,306 |
| Issued: | Aug. 26, 1980 |
| Appl. No.: | 16,737 |
| Filed: | Mar. 2, 1979 |

[30] Foreign Application Priority Data

Mar. 7, 1978 [JP] Japan ..... 53-26120

[51] Int. Cl.[5] ..... F04D 25/16
[52] U.S. Cl. ..... 415/62; 415/66
[58] Field of Search ..... 415/60, 62, 66, 68, 415/143, 199.1, 199.2, 199.3, 199.6,

[56] References Cited

U.S. PATENT DOCUMENTS

| | | | |
|---|---|---|---|
| 1,050,419 | 1/1913 | Banner | 415/199.2 |
| 2,473,356 | 8/1946 | Birmann | 60/39.17 |
| 3,001,692 | 9/1961 | Schierl | 415/66 |

FOREIGN PATENT DOCUMENTS

| | | |
|---|---|---|
| 530662 | 12/1921 | France . |
| 84903 | 11/1973 | Japan . |
| 689353 | 3/1953 | United Kingdom . |
| 992651 | 5/1965 | United Kingdom . |

OTHER PUBLICATIONS

Shepherd, D. G. "Principles of Turbomachinery" Macmillan Co., 1968, pp. 34–39.
Dixon, S. L. "Fluid Mechanics, Thermodynamics of Turbomachinery" Pergamon Press, 1978, pp. 12–13.
"Fluid Mechanics, Acoustics, and Design of Turbomachinery; Part II" (Symposium) N.A.S.A., 1970, pp. 543–556.
Gahkai, N. K. "Kikai Zushu, Sohuki-Asshakaki" 1976, pp. 50–51 & 56–57.
"Mitsubishi Juko Goho" vol. 12, No. 3 1975, pp. 44.
Church, A. H. "Centrifugal Pumps & Blowers" Wiley & Sons, Inc., 1944, pp. 49–57, 64–67 & 240–241.

*Primary Examiner*—Louis J. Casaregola

[57] ABSTRACT

The impellers of two rotary compressors are respectively fixed to the opposite ends of each shaft of a plurality of shafts, the compressors being connected in succession by connecting pipes to constitute a single multistage combination of the compressors in successive compression stages, the impeller of the preceding stage of the impellers on each shaft having a gas exit flow angle which is less than that of the impeller of the succeeding stage thereby to cause the specific speed of each impeller to be at its optimal value.

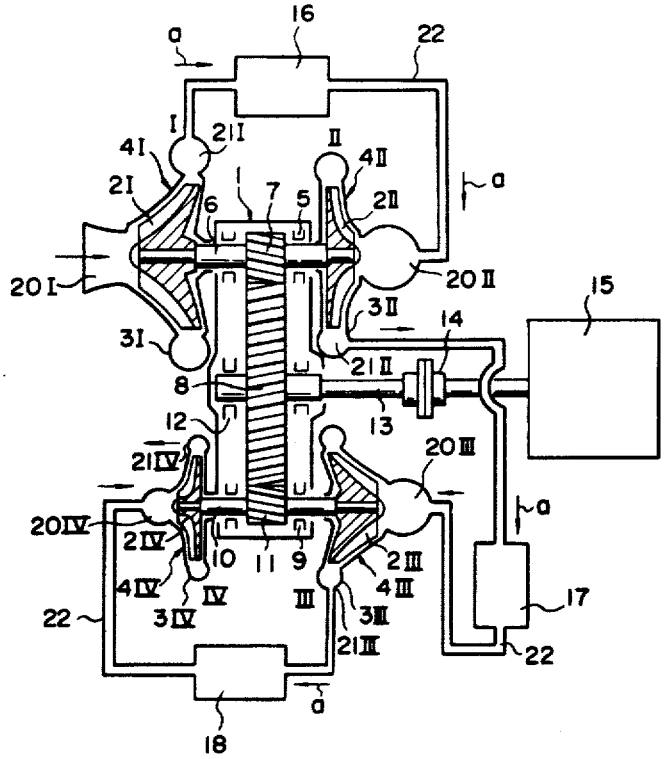

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–6 is confirmed.

New claim 7 is added and determined to be patentable.

*7. A multistage turbocompressor comprising: a plurality of rotary compressors for compressing a gas provided with respective impellers and connected by gas conducting means to constitute a single multistage combination of the compressors in successive compression stages; a plurality of separate rotating shafts each supporting a plurality of the impellers of consecutive stages; and motive power means for driving the rotating shafts, an impeller of a preceding stage among the impellers on each shaft having an exit flow angle which is less than that of the impeller of the succeeding stage such that the ratio of the specific speed for said preceding stage to the specific speed for said succeeding stage is equal to the square root of the ratio of the volumetric flow rate entering the preceding stage to the volumetric flow rate entering the succeeding stage thereby to cause the specific speeds of said preceding and succeeding stage impellers to be at the respective optimum values thereof, the exit flow angle of an impeller being the angle between the velocity component along a streamline within an imaginary meridional plane in the gas flow path through an impeller from its flow entrance to its flow exit.*

* * * * *